US005875606A

United States Patent [19]

Jensen

[11] Patent Number: 5,875,606

[45] Date of Patent: Mar. 2, 1999

[54] WALL REPAIR JACK

[75] Inventor: Lars Dean Jensen, Arlington, Tex.

[73] Assignee: Jensen R&D Corporation, Arlington, Tex.

[21] Appl. No.: 859,126

[22] Filed: May 20, 1997

[51] Int. Cl.[6] ..... E04G 23/02

[52] U.S. Cl. ..... 52/741.41; 52/514; 52/98; 254/100; 254/108; 411/2; 411/340; 411/389

[58] Field of Search ..... 52/514, 98, 741.41; 254/100, 108; 29/239, 266; 411/340, 388, 389, 546, 2

[56] References Cited

U.S. PATENT DOCUMENTS

| | | | |
|---|---|---|---|
| 1,117,662 | 11/1914 | Graham | 254/100 |
| 2,638,774 | 5/1953 | Wieman . | |
| 3,325,944 | 6/1967 | Haut . | |
| 3,690,084 | 9/1972 | Leblanc . | |
| 3,834,107 | 9/1974 | Standing . | |
| 3,936,988 | 2/1976 | Miceli . | |
| 4,075,809 | 2/1978 | Sirkin | 52/514 |
| 4,189,891 | 2/1980 | Johnson et al. | 52/514 X |
| 4,193,243 | 3/1980 | Tiner . | |
| 4,408,429 | 10/1983 | Neal . | |
| 4,471,594 | 9/1984 | Doyle . | |
| 4,848,056 | 7/1989 | Kelly . | |
| 4,945,700 | 8/1990 | Powell . | |
| 5,018,331 | 5/1991 | Foranzo | 52/514 X |
| 5,048,796 | 9/1991 | Maldonaldo . | |
| 5,117,605 | 6/1992 | Waldbeiser | 52/514 |
| 5,199,238 | 4/1993 | Maestas . | |
| 5,226,767 | 7/1993 | Foerster, Jr. | 411/340 |
| 5,555,691 | 9/1996 | Nguyen . | |

*Primary Examiner*—Carl D. Friedman
*Assistant Examiner*—Laura A. Callo

[57] ABSTRACT

A repair method which is used to restore planarity to concave damage in a wall of gypsum board construction, wherein the device is inserted through a small hole drilled in the damaged area, or inserted from the rear through a hole drilled in the back wall. Features of the device engage the opposing interior surfaces of the two wall boards. Tears and cracks in the wall are cemented. The device is manually powered in the manner of a jack to push out the damaged board pieces, which are still hingedly attached by the cardboard facing. Thus united, the cracks are bonded while the inexpensive device is left in the wall, acting as a permanent prop. Remnants of the device remaining outside of the wall are broken off and the hole is filled.

8 Claims, 6 Drawing Sheets

WALL REPAIR JACK

BACKGROUND OF THE INVENTION

1. Field of the Invention

This invention relates generally to the field of drywall repair, and more particularly to a novel device which aids in that repair.

2. Description of Prior Art

A typical wall is constructed of wood or metal studs, on whose sides drywall board is fastened. A drywall board is made of a thick central core of plaster, sandwiched between cardboard facings. Finishing of the wall includes several steps such as tape and bedding, priming, texturing, and painting.

The drywall board can be accidentally damaged by something being pushed into it. If the damage is severe, a piece of the drywall board is dislodged, creating a hole. Heretofore, most patented devices and methods have addressed only the problem of repairing the hole. These took two general approaches: a) fitting a new piece of drywall board, cut to suit as a patch into the opening; and b) backing the hole so that filler material can be trowelled into place.

Both approaches are time consuming. Cutting and fitting a new piece is repetitive, laborious, and presumes that an extra piece of drywall board is available. Trowelling a thick plug of filler cannot be done in one step. Overnight drying is usually required, whereupon shrinking causes cracking. Then the filling process must be repeated. Both of these approaches require extensive refinishing steps including texturing, an art requiring tools and skills most homeowners do not possess.

However, very often the damage is less severe, forming only a local depression in the near drywall board. Pieces of the brittle plaster core crack and tilt inward, while the cardboard facing tears or creases generally along the crack lines. Until now, no invention fully realized the advantage that these pieces, themselves are exact-fitting patch pieces, still hingedly attached on some edges by the cardboard facing. Accordingly, there is a real need for a device to exploit the advantage of restoring the wall by moving these pieces back to their original flat position. Heretofore, there was no effective way to push from inside the wall. Now comes the present invention.

SUMMARY OF THE INVENTION

It is an objective of the present invention to provide a wall repair jack device which improves the quality of a wall repair by aiding in the restoration of the flat wall surface. This objective is achieved in six steps:

a) One or more small holes (on the order of ½ inch diameter) are drilled through deflected pieces of damaged drywall, or through the rear wall.

b) A wall repair jack is inserted through each hole, whereupon support arms are deployed (or engaging members are seated.)

c) Cement is applied to the cracks and tears in the damaged wall.

d) Each wall repair jack is screwed (or pushed) to cause the support arms (or engaging members) to move in an opposing fashion, creating useful equal and opposite forces against the opposing interior surfaces of the wall.

e) Continuing this operation, and as a result of said forces, the damaged drywall pieces move until the wall surface has been restored to a plane.

f) The extension handles (if any) are broken off and the drilled holes are covered with a filler material, leaving the inexpensive wall repair jacks permanently inside the wall. The wall is then finished using conventional methods.

It is a further objective of the present invention to accomplish a wall repair in less time than was possible before. Accordingly, this ready-made wall repair jack can be installed quickly, where before time-consuming repairing methods were used, which relied on the odd materials available at hand.

Yet another objective of the present invention to aid the unskilled worker in accomplishing a successful wall repair. Accordingly, the present invention provides a wall repair jack specifically suited to the task, which can be used by a worker with minimum skill, where no such device previously existed.

Further objects and advantages of the present invention will become apparent from a consideration of the drawings and ensuing description.

Reference Numerals Used in the Drawings

Figure 1:
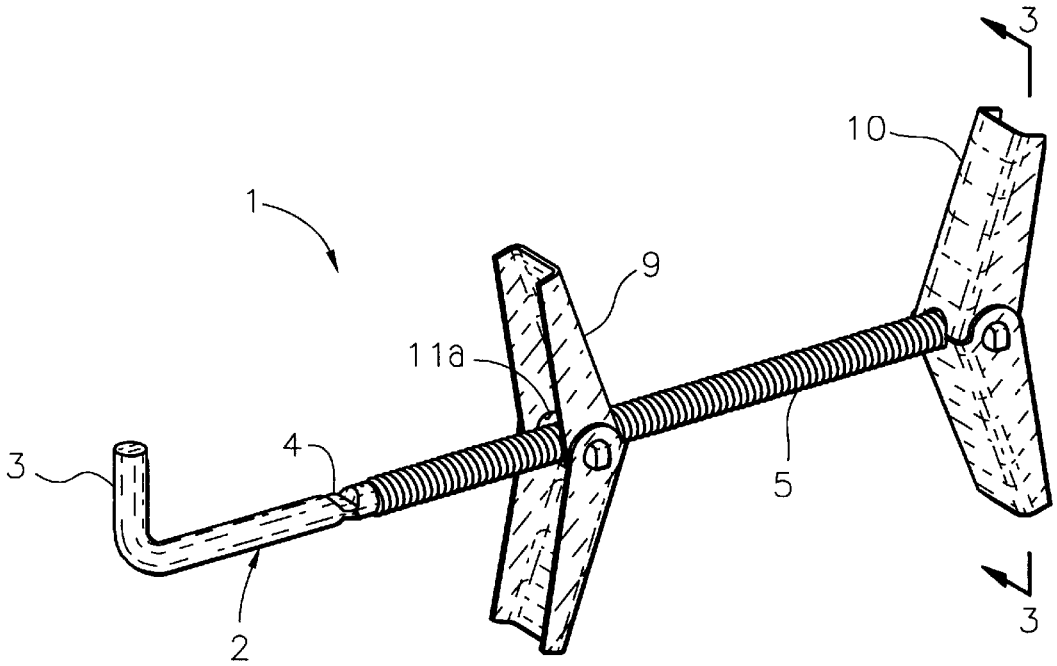
FIG. 1 is a perspective view of the present invention.

1 wall repair jack
2 threaded rod
2*a* short threaded rod
3 handle extension
4 weak flat
5 threaded feature
6 axle feature
7 tubular wall
8 washer
9 near toggle assembly
10 far toggle assembly
11*a* threaded pivot nut
11*b* smooth pivot nut
12 narrow support arm
13 wide support arm
14 torsion spring 15 direction of rotation
16 piece of broken drywall board
17 drilled hole

18 interior surface of near drywall
19 interior surface of far drywall
20 cement
21*a* outward movement
21*b* helical movement
22 Oscillating movement
23 spackling compound
24 slotted head
25 plain tip
26 headed tip
27 rotatable pad
28 tooth feature
29 toothed near toggle assembly
30 toothed far toggle assembly
31 elongated member
32 far end
33 near end
34 series of teeth
35 wall engaging member
36 step
37 grip surface
38 pawl
39 thin web
40 far end tube
41 female thread
42 near idle toggle

DETAILED DESCRIPTION OF THE INVENTION

Throughout the following descriptions, the term "near" to meant as the side of the wall with the concave damage, and "far" is meant to be in the direction of the unseen second wall. When the present invention is inserted through a drilled hole, the "near" end would be sticking out of the hole and the "far" end would be the end deepest into the wall cavity.

Figure 4:
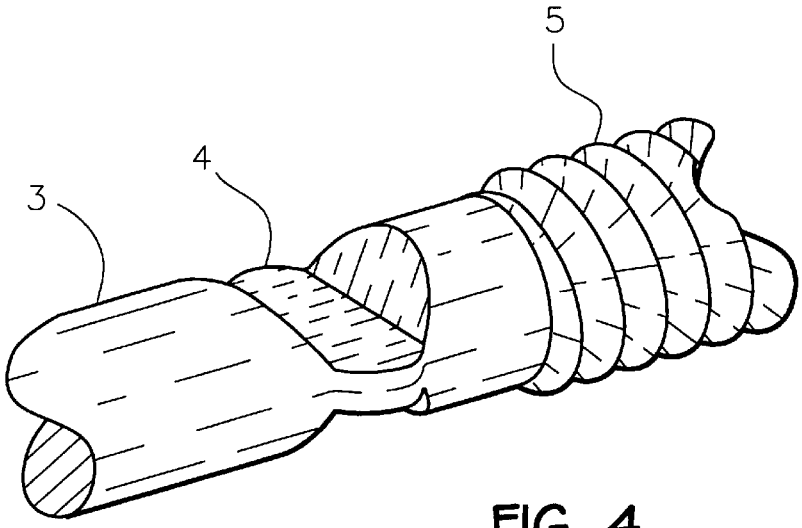
FIG. 4 is an enlarged perspective view of the weak flat.

An overview of the preferred embodiment of the present invention is shown in FIG. 1 as a wall repair jack 1. A threaded rod 2 has a handle extension 3 which is used to insert the wall repair jack through a drilled hole 17 (seen in FIG. 5) in the wall and also to turn the threaded rod. There is a weak flat 4, an enlarged view of which is shown in FIG. 4, which is a feature allowing the handle extension to be broken off at the end of the installation, as will be shown in FIG. 6. The optimal weak flat would be strong in torsion, yet weak in bending.

The threaded rod 2 has a threaded feature 5 on which a near toggle assembly 9 mates, rotates, and traverses. A far toggle assembly 10, on the other hand, is rotatably fixed to the end of the threaded rod, fitted onto an axle feature 6 along with a washer 8 as shown in FIG. 2.

Figure 2:
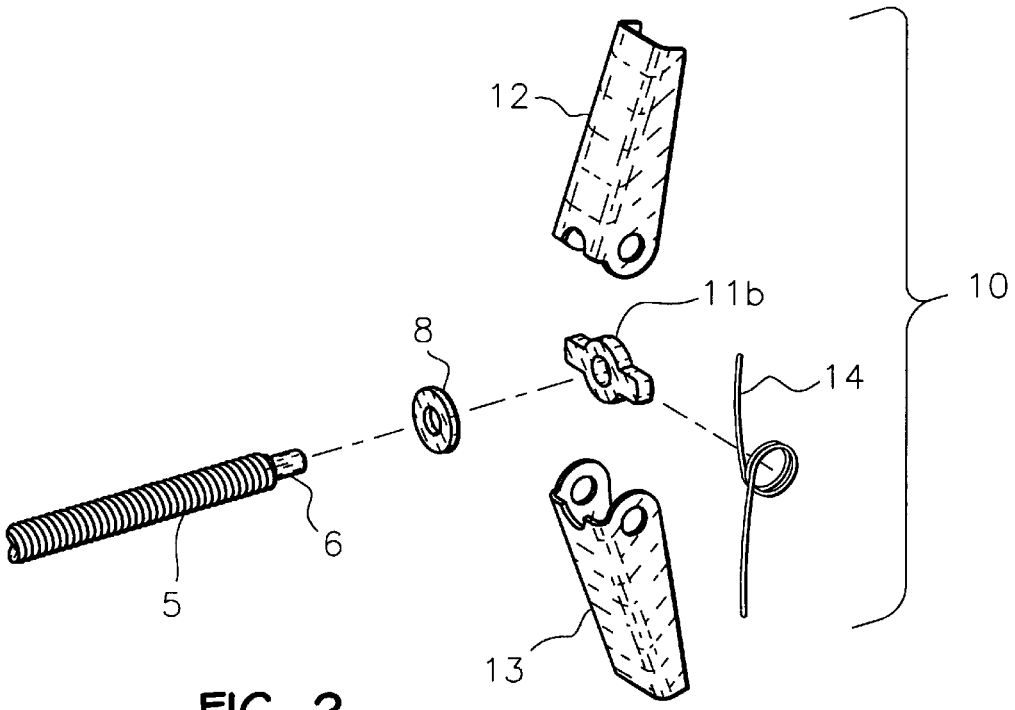
FIG. 2 is an exploded perspective view showing the parts comprising the toggle assembly.

FIG. 2 also shows the parts that make up the far toggle assembly 10. A narrow support arm 12, which is typically made of formed sheet metal, nests within a wide support arm 13, which is of similar construction. A torsion spring 14 maintains a constant torque bias, urging the support arms to open. Both support arms and the torsion spring are mounted on a smooth pivot nut 11*b* in a fashion which permits each support arm to rotate about an axis perpendicular to the axis of the threaded rod 2.

Figure 3:
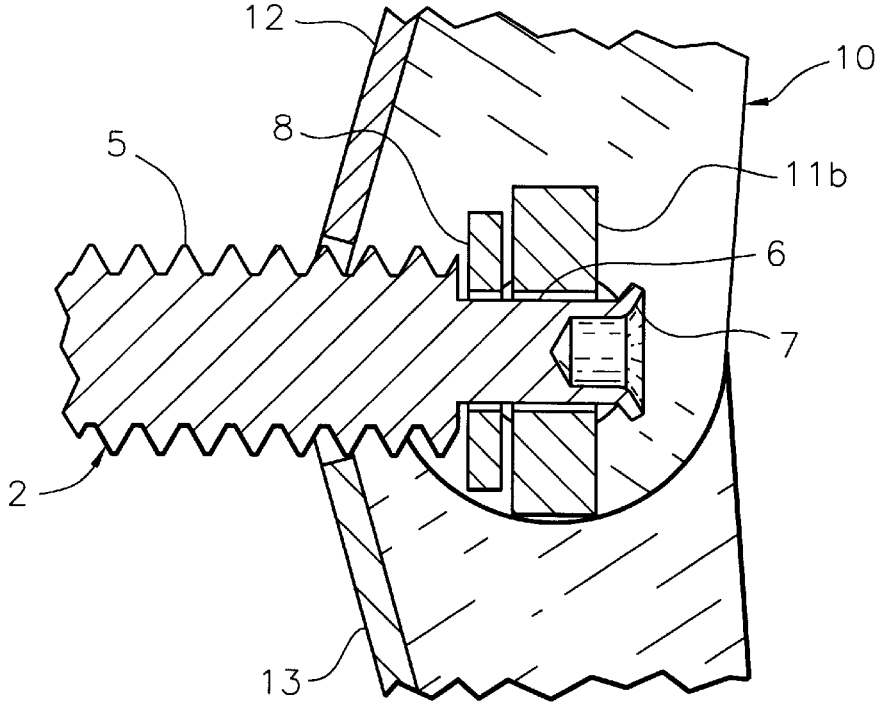
FIG. 3 is a cross-section view taken along line 3—3 of FIG. 1 showing the rotatable attachment of the far toggle assembly to the end of the threaded rod.

The smooth pivot nut 11*b* shown in FIG. 3 has a smooth bore to act as a rotary bearing surface in contact with axle feature 6. However, the threaded pivot nut 11*a*, which is part of the near toggle assembly 9 as shown in FIG. 1, has a threaded bore to mate with the threaded feature 5.

FIG. 3 shows in cross-section how the far toggle assembly 10 is rotatably fixed on the end of the threaded rod 2. A washer 8 is fitted over the axle feature 6 and acts as an axial thrust bearing. After fitting the far toggle assembly on the axle feature, a tubular wall 7 is permanently distorted. This is done by tooling similar to that used to upset conventional tubular rivets. There is predetermined axial clearance remaining which assures free rotation of the washer and far toggle assembly.

The far toggle assembly 10 will also fit and rotate suitably on the axle feature 6 if the smooth pivot nut 11*b* is replaced with the threaded pivot nut 11*a*. This would make the far toggle assembly identical to the near toggle assembly 9, the invention thus embodied would be easier to mass produce.

Figure 5:
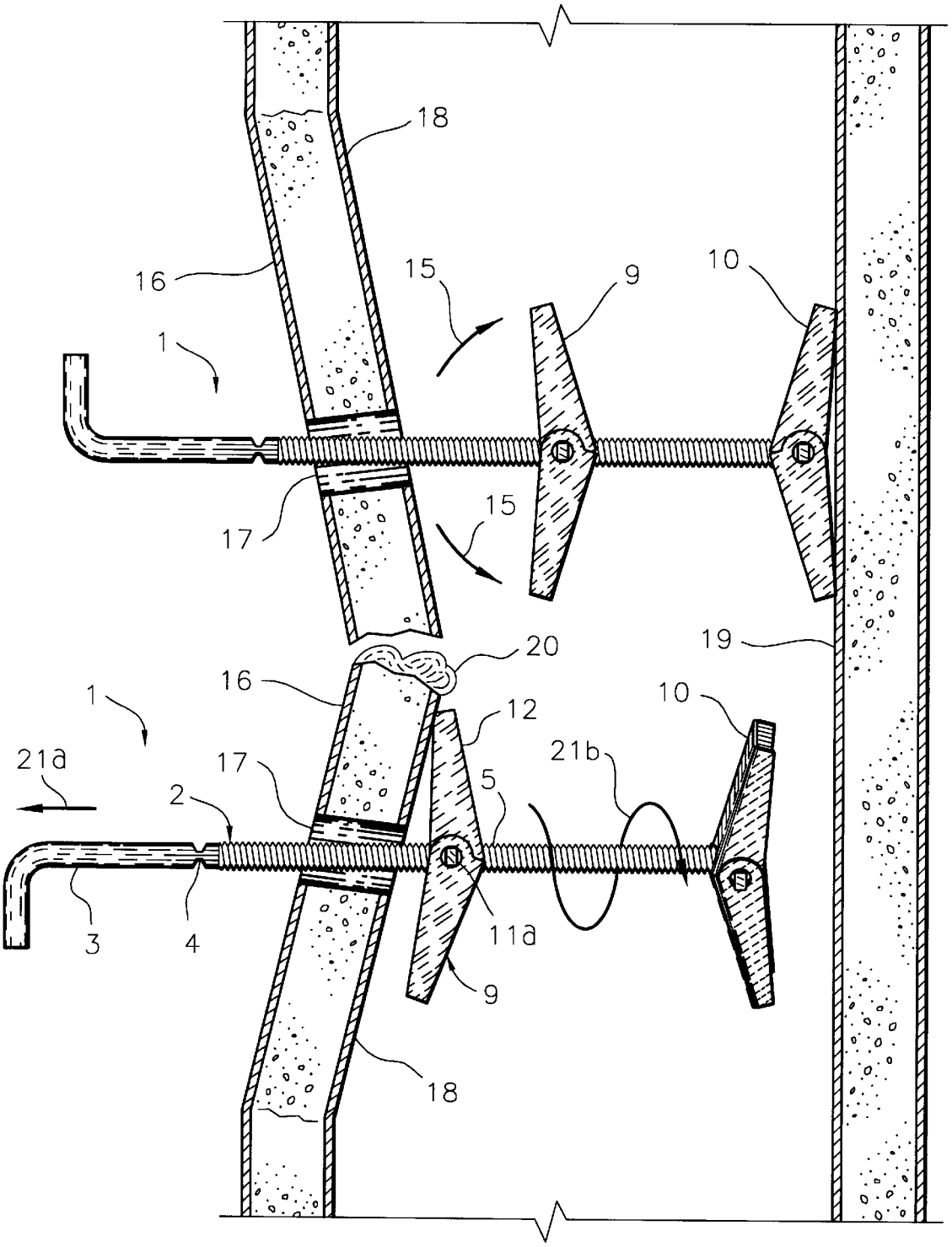
FIG. 5 is a cross-section view of a damaged wall showing two of the present invention each inserted through a drilled hole.

FIG. 5 shows a cross-section of a damaged wall with two pieces of broken drywall board 16, each with a drilled hole 17, through which a wall repair jack 1 has been inserted. Both the far toggle assembly 10 and the near toggle assembly 9 must be retracted by hand to fit through the drilled hole and then will swing open once inside the wall cavity in the direction of rotation shown by the arrows noted by reference numeral 15 as shown in the upper part of the figure.

The wall repair jack 1 shown in the lower part of FIG. 5 is in a position having been pulled in an outward movement as shown by the arrow designated by numeral 21*a* by the handle extension 3, so that the support arm 12 makes contact with the interior surface of the near drywall 18, thus restraining the near toggle assembly 9 from turning. This done, it is possible to turn the handle extension, advancing the threaded rod 2 by the screw action of the threaded feature 5 coacting with the threaded pivot nut 11*a*. This helical movement is indicated by the arrow noted by reference numeral 21*b*. The far toggle assembly 10, turns in unison with the threaded rod until it contacts the interior surface of the far drywall 19, at which time it also becomes restrained from turning. Now, after a few more degrees of additional rotation, equal and opposite forces are generated by the screw action against both interior surfaces. The wall repair jack becomes seated between the interior surfaces to become self-supporting. Now one's hand may be removed from the handle extension, confident that the wall repair jack will not fall into the wall cavity.

All previous steps have been preparation for the novel action which follows. A cement 20 is applied by a suitable nozzle-tip applicator to every exposed tear and crack. Without delay, the handle extension 3 is turned creating yet higher equal and opposite forces, sufficient to move the piece of broken drywall board 16 outward and toward its original position (prior to the damage) as will now be seen in FIG. 6. This action should be accomplished stepwise, by sequentially turning each wall repair jack 1 a small amount. This is because turning one wall repair jack tends to move all of the pieces of broken drywall in unison, perhaps causing another wall repair jack nearby to loosen and fall. A yardstick or other suitable straight edge may be held against the wall to judge when the planar surface has been restored, at which time no further turning is necessary.

Figure 6:
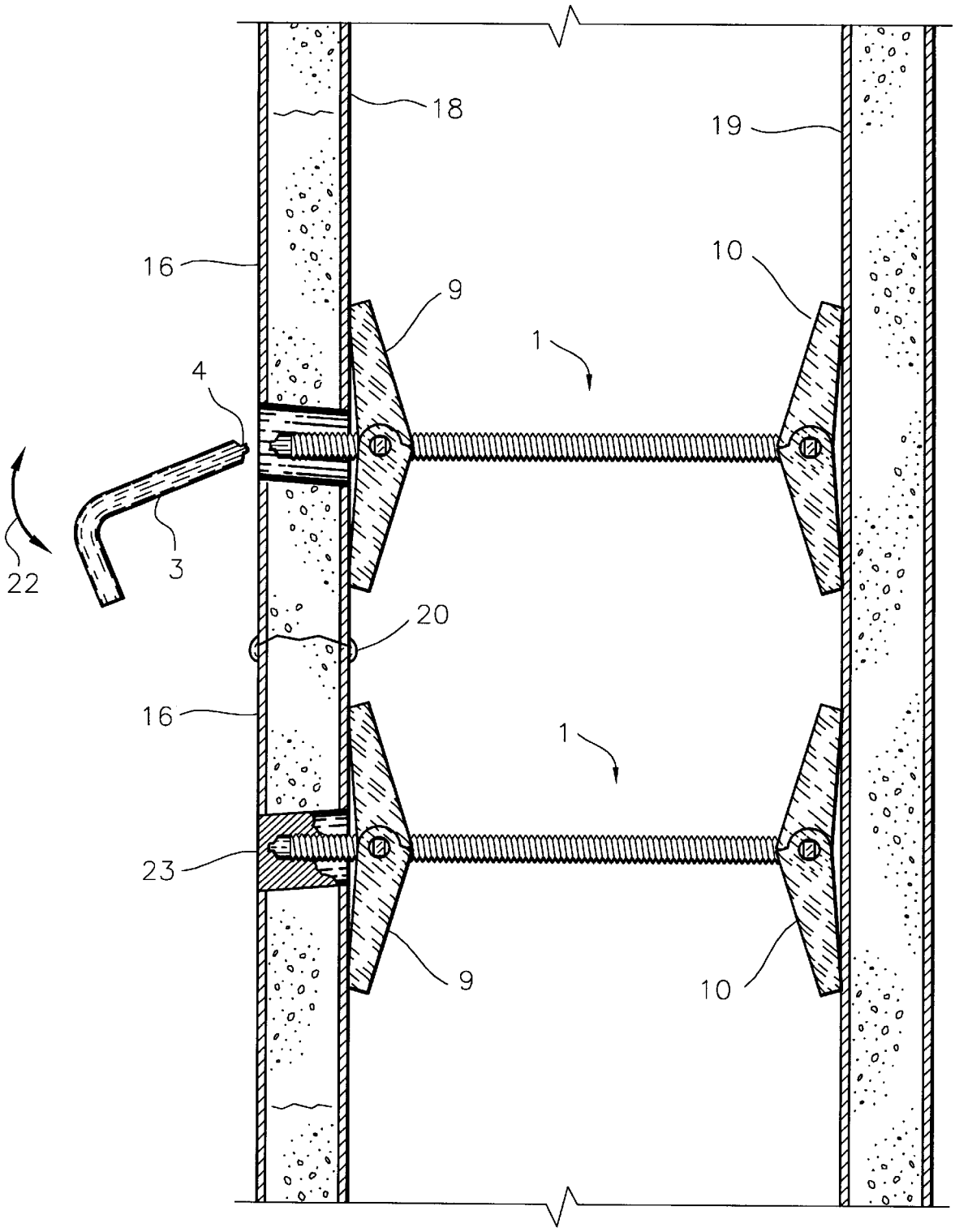
FIG. 6 is a cross-section view of a restored wall showing two of the present invention in their seated position and showing a handle extension breaking off and a drilled hole having been filled with spackling compound.

Now the restored wall is shown in the cross-section of FIG. 6. Notice that where before (FIG. 5) edges of pieces of broken drywall board 16 were apart, now they have been united, giving opportunity for the cement 20 to bond. The wall repair jack 1 shown in the upper part of FIG. 6 has had the handle extension 3 moved in an oscillating fashion as shown by the arrow noted by reference numeral 22 until finally, as a result of fatigue, the weak flat 4 has failed and separated. The freed handle extension is discarded. The weak flat was purposely located at a distance slightly less than 4 inches from the interior surface of the far drywall board 19. Thus, all portions of the remaining wall repair jack lie below the exterior plane of the wall. The wall repair jack shown in the lower position has had the drilled hole 17 filled and covered flush by spackling compound 23.

Figure 7:
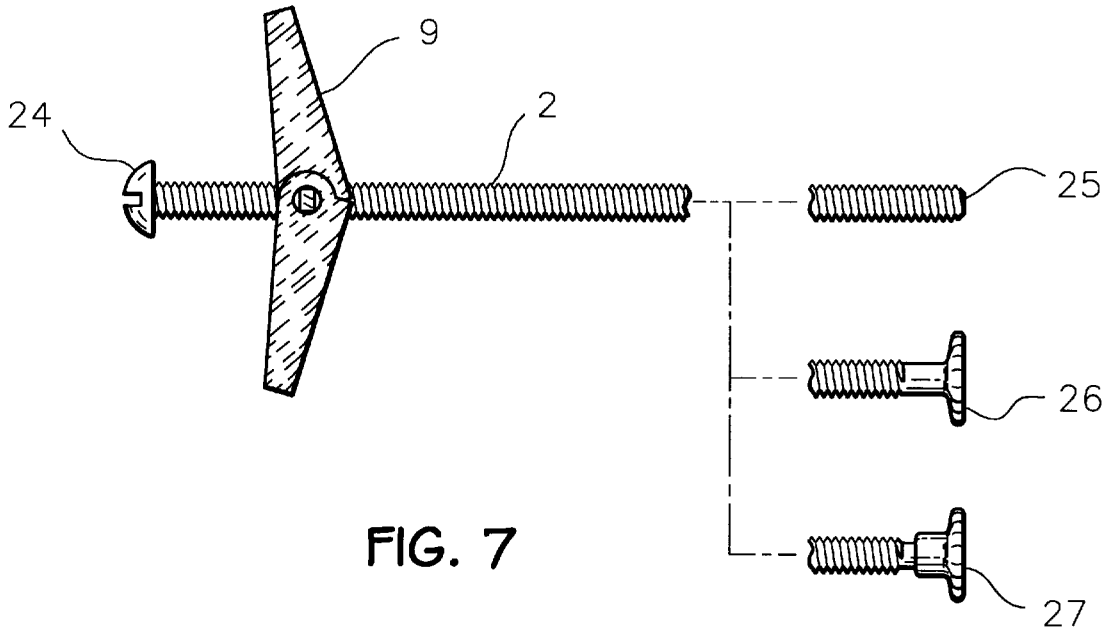
FIG. 7 is a side view of alternate end features of the present invention.

Several alternate embodiments of the present invention are shown in FIG. 7. Rather than having the handle extension 3 and the weak flat 4 (FIG. 1), there is a conventional slotted head 24. The top of this slotted head must be located slightly less than 4 inches from the other end, so as to be entirely inside the drilled hole when the repair is complete. This slotted head is merely one illustration of a variety of screw head features which act as a torque coupling, and which can be driven by a screw driver, alien wrench or other hand tools. While this embodiment will work, it is not the preferred embodiment because there is very little on which to hold and couple during the insertion and seating operations. Also in FIG. 7, there is shown the threaded rod 2 which has three alternate end treatments: a plain tip 25, a headed tip 26 which is an integrally fixed disk, and a rotatable pad 27 which is constructed and attached in a manner similar to that of a common "C" clamp pad. All three alternate end treatments must have diameters less than that of the drilled hole 17 (FIG. 5.) None of these end treatments would be included in the preferred embodiment, because the expandable nature of the far toggle assembly 10 (FIG. 1) better distributes the forces into the interior surface of the far drywall 19, thus reducing the likelihood of accidental breakage.

Figure 8:
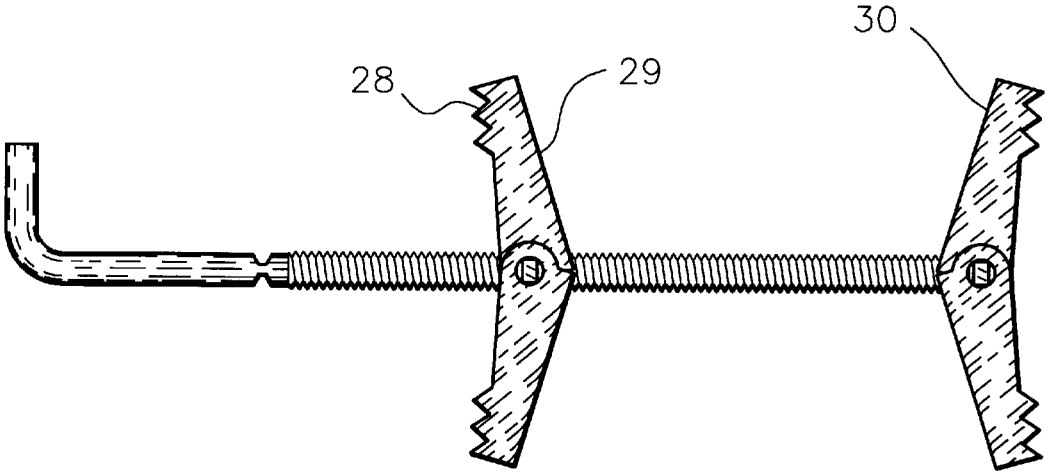
FIG. 8 is a side view of an alternate embodiment of the present invention, having toothed toggle assemblies.

FIG. 8 shows an embodiment of the present invention which seats more securely to the interior wall surfaces. A toothed near toggle assembly 29 and a toothed far toggle assembly 30 each have one or more tooth features 28 which form a toothed surface, enhancing the lateral strength of the engagement with the cardboard facing of the drywall board. The advantage of this embodiment is that the present invention is more likely to remain seated during the break-off operation of the handle extension 3 (as seen at the top of FIG. 6), as well as over the lifetime of the repair.

Figure 9:
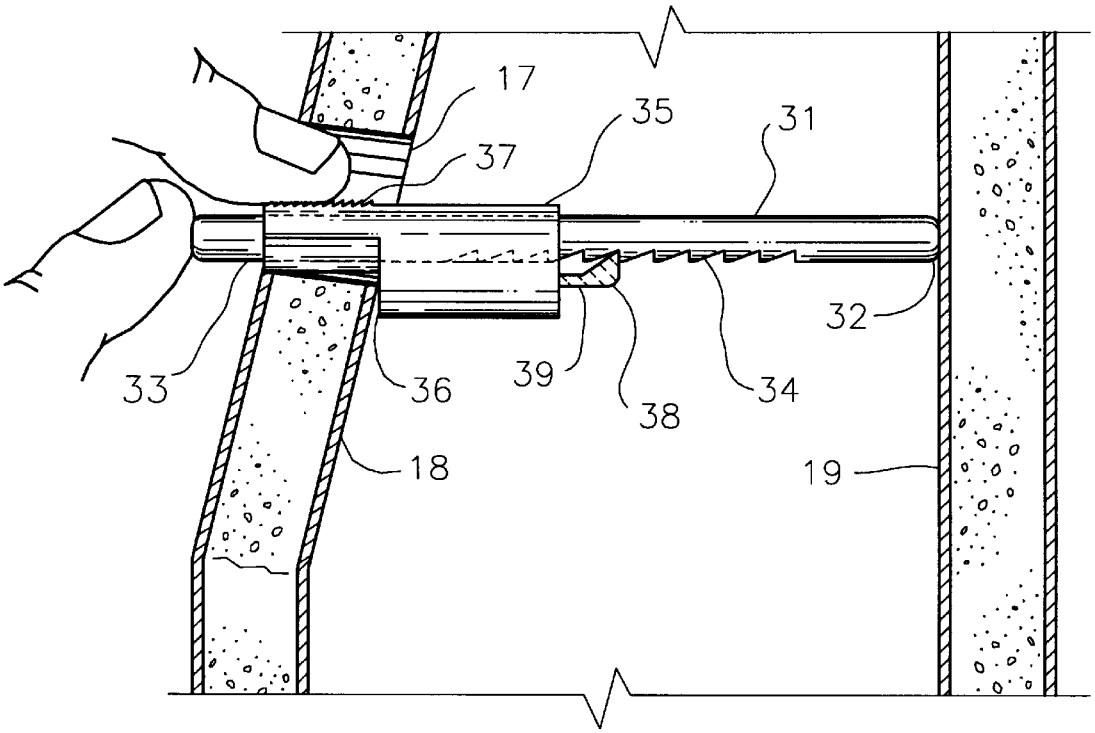
FIG. 9 is a side view of an alternate embodiment of the present invention, having only two moving parts.

Yet another embodiment of the present invention, one with only two moving parts, is shown in FIG. 9. An elongated member 31 has a far end 32 which can bear against the interior surface of the far wall 19. There is a wall engaging member 35, having a hole through which the elongated member is guidably fitted to translate. The body of the wall-engaging member is cylindrical of a diameter slightly less than that of the drilled hole 17 and there is a step feature 36. Therefore, the device can be inserted through the drilled hole, then translated laterally so the step 36 can be brought to bear against the interior surface of the near wall 18. The wall engaging member can be restrained by one's finger pressing on a grip surface 37. Then, the elongated member can be powered to extend by pressing on the near end 33. There are a series of teeth 34 in the elongated member. There is a pawl 38 which flexes by a thin web 39, acting both as a hinge and a spring. Therefore, the wall engaging member becomes fixed at its most recent position as it is powered along the elongated member. This embodiment is not the preferred embodiment, since it is relatively difficult to grasp the parts and might require the drilled hole to have a larger diameter.

Figure 10:
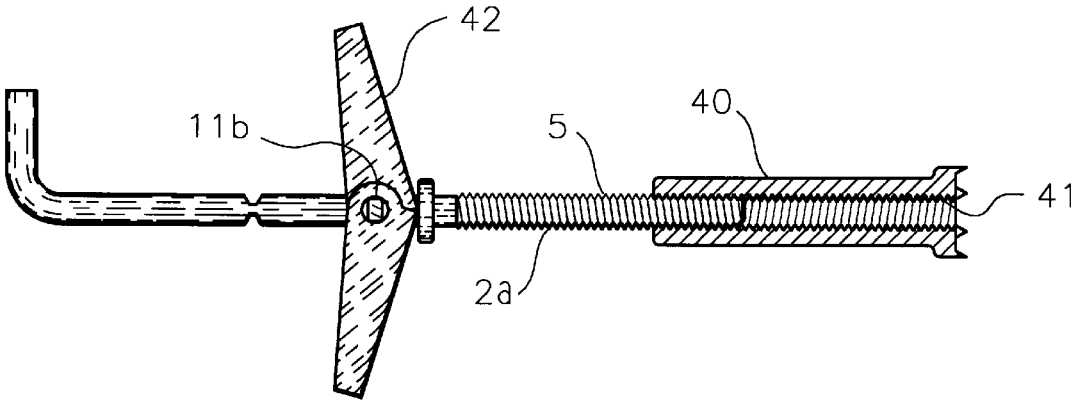
FIG. 10 is a side view of an alternate embodiment of the present invention where the far end tube moves relative to the near idle toggle.

FIG. 10 shows a side view of still another embodiment of the present invention where the screw action is reversed, a far end tube 40 is shown in cross-section revealing a female thread 41 which coacts with the threaded feature 5 to enable powered movement relative to the short threaded rod 2*a*. Here, a near idle toggle 42 is rotatably attached, but does not translate, since it includes a smooth pivot nut 11*b*. This is not a preferred embodiment, since it has a shorter range of movement and might be more expensive to manufacture.

A unique method of using the present invention, which demonstrates its versatility, is to insert the device from the rear through a hole drilled in the far wall. One advantage to this method would be in the case where the damaged near wall is covered with decorative wall paper. No other method or device would offer the possibility of restoring such a surface with only minor gluing and fitting. Of course, the rear drilled hole would need to be filled and finished as usual.

Toggle assemblies shown in these embodiments are only by way of illustration, since yet other embodiments are anticipated where they are replaced by other expandable support means, such as are commonly available as a variety of anchoring fasteners, being actuated by wedges and the like.

While the present invention anticipates the use of familiar parts, such as toggles, it will be realized that these common machine elements are combined in a novel way to accomplish a novel objective. One embodiment, shown in FIG. 7, comprises a toggle and a long screw, however as combined by the present invention, they are used for pushing apart, rather than the usual grasping between.

Although the present invention has been described with respect to the specific embodiments illustrated, it is understood that the invention can be modified and utilized in various ways. For example, the present invention could be put to good use repairing any twin wall structure, such as hollow core doors, partitions, and other like building structures. These and other modifications are to be deemed within the spirit and scope of the following claims.

What is claimed is:

1. A method of repairing a depression in a drywall board, wherein the drywall board has a substantially planar front surface surrounding the depression and the depression comprises a piece of said drywall board which is deflected rearwardly out of said planar front surface, the method comprising the steps of:

a) providing an apparatus having a threaded rod with a handle, a far expandable means, and a near expandable means;

b) drilling a hole through the deflected piece of said drywall board;

c) retracting said expandable means, inserting said apparatus through said hole in said deflected piece of said drywall board, and allowing the expandable means to deploy; and d) engaging the near expandable means against a rear surface of the deflected piece of drywall board and rotating said handle causing said near expandable means to move along said threaded rod until the far expandable means contacts an opposing wall surface and the near expandable means pushes the deflected piece until a front surface of the deflected piece is brought flush with the planar front surface of the drywall board.

2. The method of claim 1, further comprising breaking off said handle.

3. The method of claim 2, further comprising filling said hole in said deflected piece with a filler material.

4. The method of claim 1, further comprising applying cement to any exposed cracks or tears in said drywall board at said depression prior to step (d).

5. A method of repairing a depression in a drywall board, wherein the drywall board has a substantially planar front surface surrounding the depression and the depression comprises a piece of said drywall board which is deflected rearwardly out of said planar front surface, the method comprising the steps of:

a) providing an apparatus having a threaded rod with a handle, a far rotatable pad, and a near expandable means;

b) drilling a hole through the deflected piece of said drywall board;

c) retracting said expandable means, inserting said apparatus through said hole in said deflected piece of said drywall board, and allowing the expandable means to deploy; and d) engaging the near expandable means against a rear surface of the deflected piece of drywall board and rotating said handle causing said near expandable means to move along said threaded rod until the far rotatable pad contacts an opposing wall surface and the near expandable means pushes the deflected piece until a front surface of the deflected piece is brought flush with the planar front surface of the drywall board.

6. The method of claim 5, further comprising breaking off said handle.

7. The method of claim 6, further comprising filling said hole in said deflected piece with a filler material.

8. The method of claim 5, further comprising applying cement to any exposed cracks or tears in said drywall board at said depression prior to step (d).

* * * * *